US008449000B2

(12) United States Patent
Rhyneer

(10) Patent No.: US 8,449,000 B2
(45) Date of Patent: May 28, 2013

(54) SHOCK-ACTUATED LOCK

(76) Inventor: George Rhyneer, Eagle River, AK (US)

( * ) Notice: Subject to any disclaimer, the term of this patent is extended or adjusted under 35 U.S.C. 154(b) by 0 days.

(21) Appl. No.: 12/890,588

(22) Filed: Sep. 24, 2010

(65) Prior Publication Data

US 2011/0187251 A1 Aug. 4, 2011

Related U.S. Application Data

(63) Continuation of application No. 11/146,615, filed on Jun. 6, 2005, now abandoned.

(51) Int. Cl.
*E05C 17/56* (2006.01)
*E05C 19/16* (2006.01)

(52) U.S. Cl.
USPC ..... 292/251.5; 292/92; 292/DIG. 65; 16/82

(58) Field of Classification Search
USPC ..... 292/92, 251.5, 304, DIG. 65; 16/82
See application file for complete search history.

(56) References Cited

U.S. PATENT DOCUMENTS

| | | | | |
|---|---|---|---|---|
| 2,215,044 | A | 9/1940 | Kammerdiner | |
| 2,693,615 | A | 11/1954 | Hatke | |
| 2,970,857 | A * | 2/1961 | Squire | 292/251.5 |
| 3,312,492 | A * | 4/1967 | Remhof | 292/201 |
| 3,635,511 | A | 1/1972 | Waller | |
| 3,658,370 | A | 4/1972 | Wang | |
| 3,860,277 | A | 1/1975 | Wang | |
| 3,913,958 | A * | 10/1975 | Larime | 292/251.5 |
| 4,270,781 | A | 6/1981 | Nishimura | |
| 4,339,853 | A | 7/1982 | Lipschitz | |
| 4,652,029 | A | 3/1987 | Yamamoto | |
| 4,714,286 | A | 12/1987 | Yamamoto | |
| 4,739,896 | A | 4/1988 | Moss | |
| 4,865,368 | A | 9/1989 | McCall et al. | |
| 5,035,451 | A | 7/1991 | Brady | |
| 5,106,132 | A | 4/1992 | Bako et al. | |
| 5,140,836 | A | 8/1992 | Hogan et al. | |
| 5,152,562 | A * | 10/1992 | Stevenson et al. | 292/252 |
| 5,312,143 | A * | 5/1994 | Buckner | 292/230 |
| 5,518,282 | A | 5/1996 | Sawada | |
| 5,570,914 | A * | 11/1996 | Hughes | 292/130 |
| 5,597,188 | A * | 1/1997 | Miche | 292/183 |
| 5,611,579 | A * | 3/1997 | Kreitenberg | 292/130 |
| 5,626,372 | A * | 5/1997 | Vogt | 292/87 |
| 5,697,655 | A | 12/1997 | Strong | |
| 6,318,134 | B1 | 11/2001 | Mossberg et al. | |
| 6,550,827 | B1 | 4/2003 | Tsujino | |
| 6,561,555 | B1 | 5/2003 | Millard | |
| 6,588,811 | B1 | 7/2003 | Ferguson | |
| 6,866,312 | B1 * | 3/2005 | Rhyneer | 292/252 |

FOREIGN PATENT DOCUMENTS

| | | |
|---|---|---|
| JP | 9-67970 | 3/1997 |
| JP | 9-78926 | 3/1997 |
| JP | 10115141 A * | 5/1998 |
| WO | 9601935 A | 1/1996 |

* cited by examiner

*Primary Examiner* — Carlos Lugo
(74) *Attorney, Agent, or Firm* — DWC Law Firm, P.S.; David Chen

(57) ABSTRACT

A lock that is actuated by an actuating force, such as that caused by an earthquake, for locking a door of a compartment or other enclosure. A magnet can be embedded on an inside surface of a door of the compartment. A displaceable component is provided within the compartment. An actuating force can displace a position of the displaceable component such that it can be aligned with the magnet. The displaceable component can be attracted to the magnet and thereby lock the door in a closed position.

3 Claims, 9 Drawing Sheets

SHOCK-ACTUATED LOCK

CROSS REFERENCE TO RELATED APPLICATION(S)

This application is a continuation of U.S. patent application Ser. No. 11/146,615, filed Jun. 6, 2005.

BACKGROUND OF THE INVENTION

1. Field of the Invention

The present invention relates to magnetic locks for cabinets and other compartments or enclosures, including earthquake locks for cabinets using magnets.

2. Description of the Prior Art

Earthquakes are inevitable in many parts of the world, and can be a constant potential hazard that some persons must live with on a daily basis. Many earthquakes, however, are not catastrophic events. Nonetheless, minor or moderate earthquakes may still cause damage as items are thrown off shelves and contents of closed cabinets or other enclosures are discharged. Some cabinets have doors with locks that can help prevent damage to the contents of the cabinets if the doors remained closed or locked during such earthquakes.

For example, U.S. Pat. No. 5,152,562 teaches a locking device that uses a ball that is held in an elevated position in a housing. At the base of the housing is a latch that attaches to the inside of a cabinet door. The latch has a slot cut into it such that when the door is closed, the slot is positioned under the ball. When an earthquake strikes, if the force is sufficient it causes the ball to be displaced from its resting position and clown into the slot. This can then prevent the door from opening and spilling the contents of the cabinet. However, if the movement that causes the ball to drop also causes the door to fly open before the ball drops into the slot, the lock will not be effective. Indeed, if the door has opened widely enough and the ball drops into the slot, the dropped ball may even block the door from closing again. Also, once the lock is set, additional devices are needed to open the cabinet again. The patent teaches securing a string that passes through the side of the cabinet so that a user can pull the ball back up so that the door can be opened.

Another example is U.S. Pat. No. 5,518,282 that teaches a system that keeps a door or drawer locked on a more continuous basis. The patent discloses a hooked shaped latch that hooks onto a ledge attached to the door. There is a release mechanism provided that allows the door to be opened for ordinary use. While this device eliminates the need for a device to lock the door in the event of an earthquake, one of its drawbacks is that it may create inconvenience in accessing the contents of the cabinets on a continuous basis.

Two systems have been developed in Japan as well. JP9067970A2 and JP9078926A2 are directed toward the use of balls to engage latches to prevent doors from opening in the event of an earthquake. JP9067970A2 teaches a system similar to U.S. Pat. No. 5,152,562 in that a ball is designed to drop into a bracket with a slot that is attached to the door. JP9078926A2 teaches a system in which a ball drops down and engages a spring mechanism that causes two pins to laterally move into holes drilled in the doors. Once the pins are in place, the doors will not open. However, in JP9067970A2, if the doors are opened before the ball completes its drop, the ball does not align with the slot in the bracket. Also, in JP9078926A2, the same occurrence can cause the pins not to align with the holes in the doors. Thus, the locks in both of those disclosed inventions can be rendered ineffective by timing in the sequence of events. The present invention seeks to overcome, among other things, some of the problems present in existing systems.

BRIEF SUMMARY OF THE INVENTION

In some embodiments of the present invention, a track assembly and latch are provided. The track assembly and latch can be disposed within, or otherwise coupled to, a cabinet (or other compartment or enclosure) having a door. The door can have a magnet (e.g. permanent magnet) coupled to a surface thereof or embedded within the door. The latch has a contact surface that is attracted to the magnet. An actuating force or "event," such as an earthquake, can cause the latch to fall from an upright position within the track assembly, to a horizontal position within the track assembly. In the upright position, the contact surface of the latch is not alignable with a magnet coupled to the door. However, when the latch falls to the horizontal position, the contact surface of the latch is alignable with the magnet when the door of the cabinet is in a closed position. When both the latch has fallen to a horizontal position and the door has closed, the magnet exerts sufficient magnetic attraction on the aligned contact surface to lock the door closed. That is, the latch is retained in the track assembly while the magnet and contact surface interact to prevent the door from reopening under further actuating forces. In some embodiments, the contact surface does not actually need to touch a face of the magnet, but is sufficiently proximate the magnet to effectuate a lock that prevents subsequent actuating forces from reopening the door. For example, the magnet can be embedded within a door but still exert a magnet field that magnetically interacts with the contact surface of the latch sufficiently to lock the door. In other embodiments of the present invention, the contact surface of the latch does directly touch the magnet to effectuate the lock.

In various embodiments of the present invention, the magnet and material and configuration of the latch (or the contact surface of the latch) can be selected to produce a sufficiently strong magnetic attraction therebetween to securely hold the door closed during certain actuating forces, such as a moderate seismic event, but to also allow the locking force to be overcome by a user. Thus, a person can reopen the door of the cabinet against the force of attraction of the magnet without unreasonable strain, by pulling on a handle of the door. In some embodiments, the latch or contact surface of the latch can comprise ferromagnetic material. The latch can be reset by pulling the door open and placing the latch in its original upright position. Also, in some embodiments, the contact surface of the latch is a magnet while a component attractable to the magnet is coupled to the door, as will be appreciated by those skilled in the art after reviewing this disclosure. In such embodiments of the present invention, a lock can be effectuated by reversing the position of the magnet (e.g., permanent magnet) and the ferromagnetic material.

BRIEF DESCRIPTION OF THE SEVERAL VIEWS OF THE DRAWING(S)

DETAILED DESCRIPTION OF THE INVENTION

In the following description, certain specific details are set forth in order to provide a thorough understanding of various embodiments of the present invention. However, upon reviewing this disclosure one skilled in the art will understand that the invention may be practiced without many of these details. In other instances, well-known structures and materials of construction associated with magnets (e.g., permanent magnets) and various metals that display strong attraction to such magnets, such as ferromagnetic materials, and various types of structures that have compartments or enclosures and doors, have not been described in detail to avoid unnecessarily obscuring the descriptions of the embodiments of the invention. The drawings are intended only to be examples and are in no way exhaustive as to the application of the present invention, as will be appreciated by those skilled in the art after reviewing this disclosure.

The discussion below discloses, among other things, using various embodiments of locking devices, methods and assemblies of the present invention with cabinets having cabinet doors, to help lock the cabinet doors in the event of seismic activity. However, as will be understood by those skilled in the art after reviewing this disclosure, various other contexts or applications of the present invention are contemplated. For example, some embodiments of the present invention are usable with other types of compartments or enclosures, that require locking during shock-type movement to help secure and protect contents of the compartment or enclosures.

The term "actuating force," as used herein, includes shock-actuating motion, such as, without limitation, seismic activity and other forces having magnitudes in excess of those encountered during normal use of the structures (e.g., cabinets and compartments) on which the locking assemblies and devices are applied.

Figure 1:
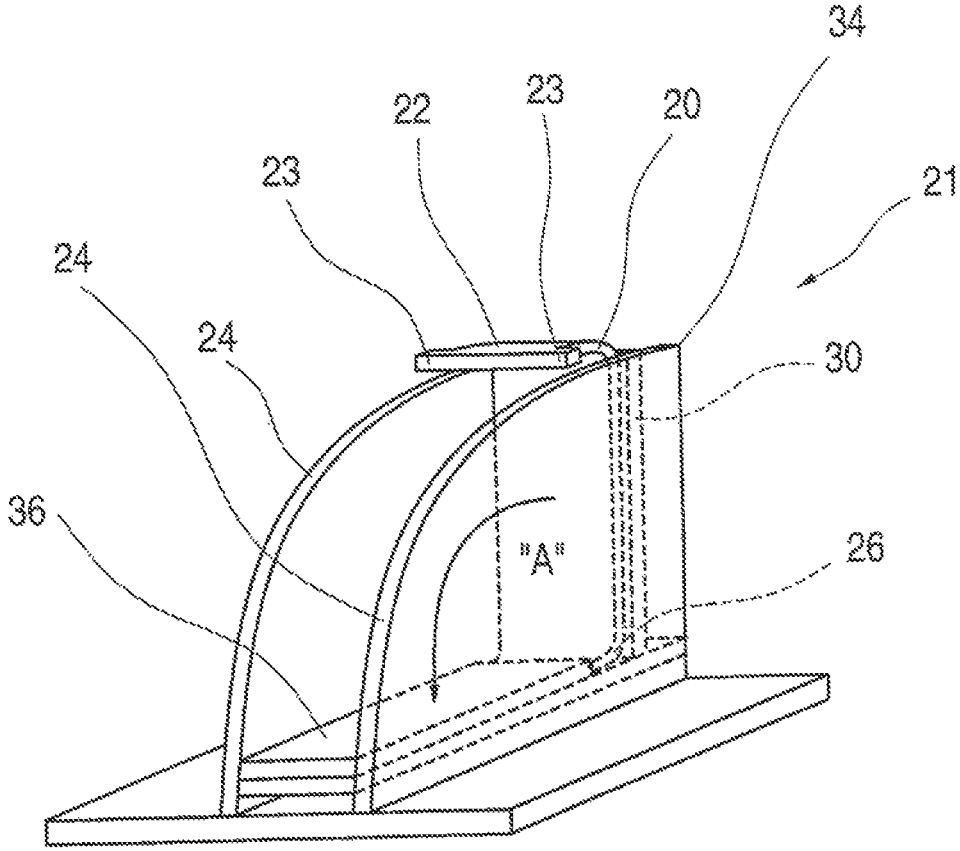
FIG. 1 is a perspective view of an embodiment of the present invention having a latch and track assembly.
Figure 4:
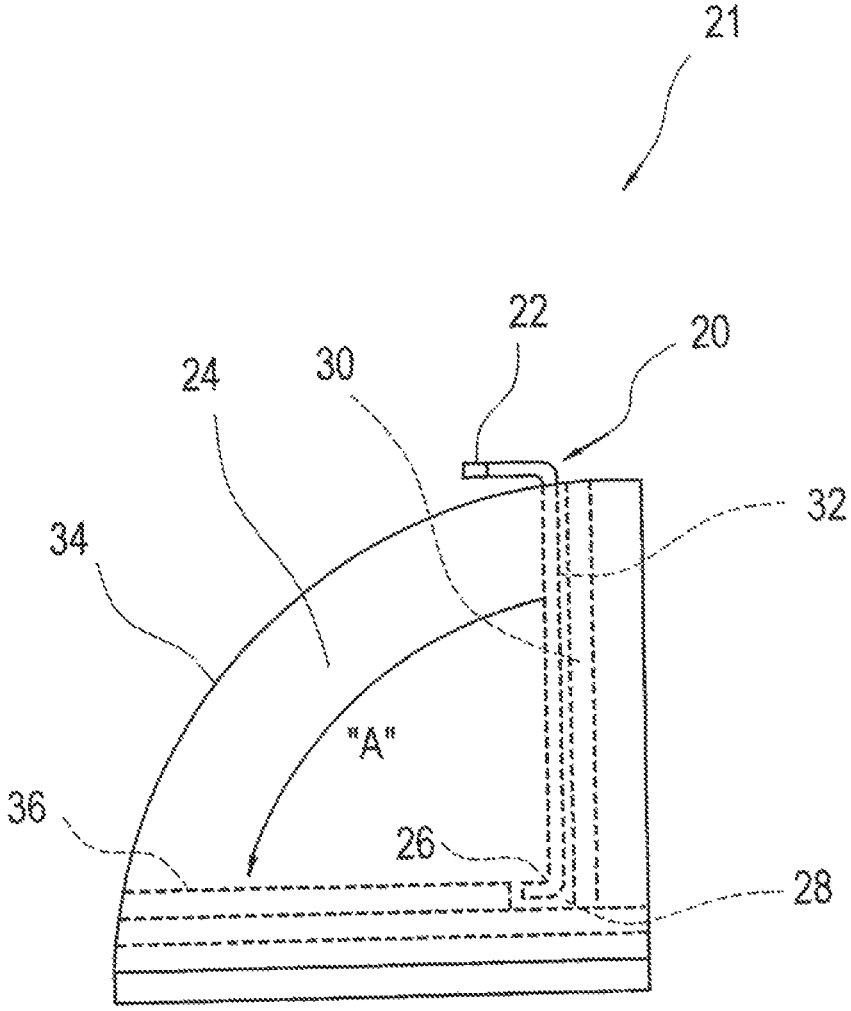
FIG. 4 is a side elevation view of the embodiment of the present invention shown in FIG. 1, with the latch in an upright position, with arrow "A" showing a direction of motion for the latch when it is actuated and falls to the horizontal position.

Referring to FIGS. 1 & 4, in some embodiments of the present invention, a locking device 21 is provided with a latch 20 having a contact surface 22 and a guide member, such as a track assembly 34, within which the latch 20 is disposed. The track assembly 34 can include track walls 24 to serve as guide members for the latch 20, a rear wall 30, and a retaining member 36. As best seen in FIG. 4, in some embodiments the retaining member 36 is disposed near the rear wall 30 with a recess 28 between the retainer 36 and the rear wall 30.

A bottom end portion of the latch 20 has a bend 26 and can be disposed within the recess 28. In FIGS. 1 & 4, the latch 20 is illustrated in an upright position wherein a back surface 32 of the latch 20 can rest against the rear wall 30 of the track assembly 34.

Figure 5:
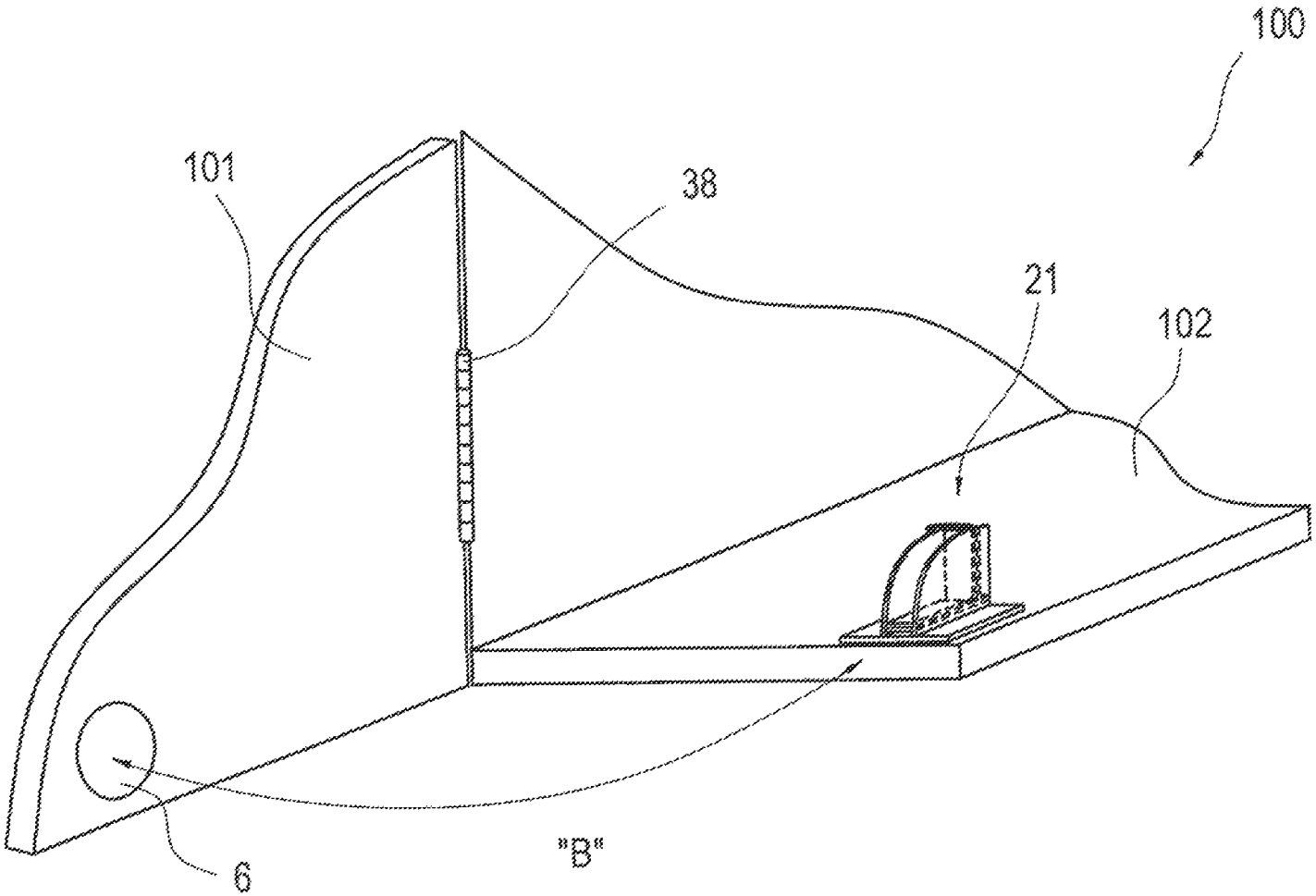
FIG. 5 is a perspective view of the locking device of FIG. 1 coupled to a compartment with a door, such as a cabinet with a door.
Figure 6:
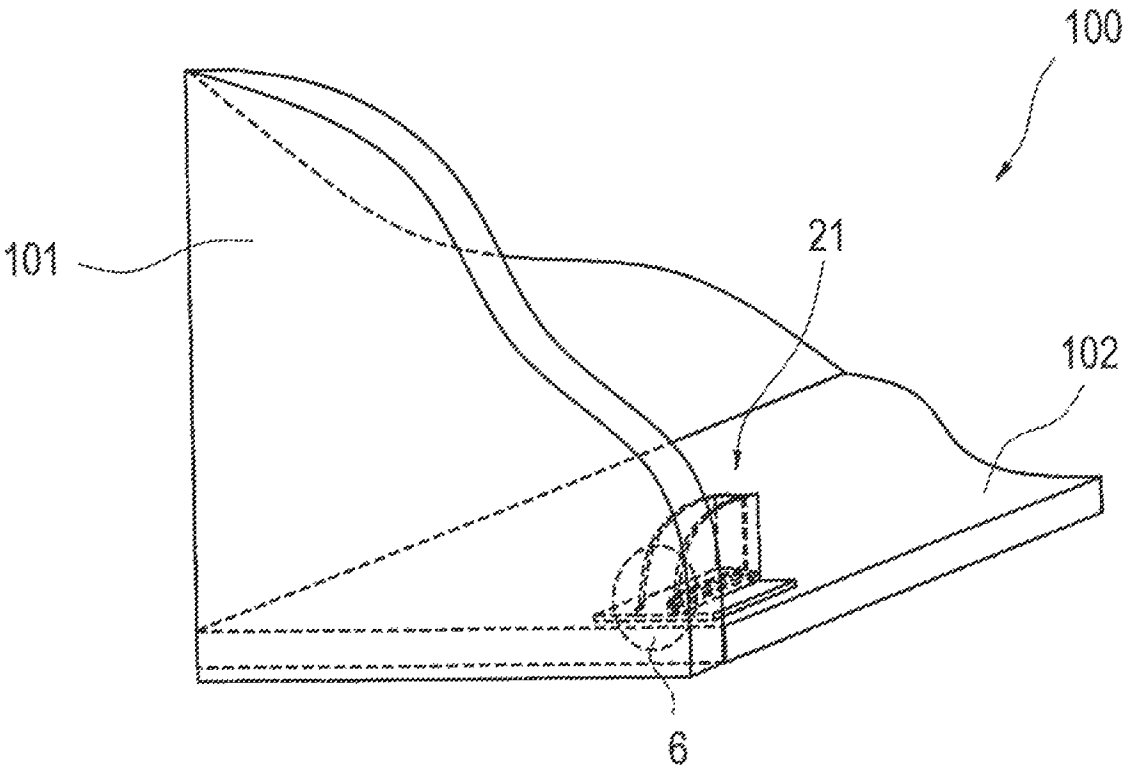
FIG. 6 is the perspective view of FIG. 5, with the door in a closed position and wherein a magnet of the door is aligned with a contact surface of the latch of FIG. 2.

Referring to FIGS. 5 & 6, the locking device 21 may be coupled to a surface 102 within a compartment or cabinet 100. An adjacent movable object or door, such as a cabinet door 101 that is hinged 38 and can swing in the directions of arrow "B" along a constant radius, can have a magnet 6 that is coupled to or embedded within the cabinet door 101. The magnet 6 and locking device 21 can be positioned so that when the cabinet door 101 swings in the direction shown by arrow "B" in FIG. 5, the magnet 6 becomes aligned with and adjacent the locking device 21, as shown in FIG. 6.

Figure 2:
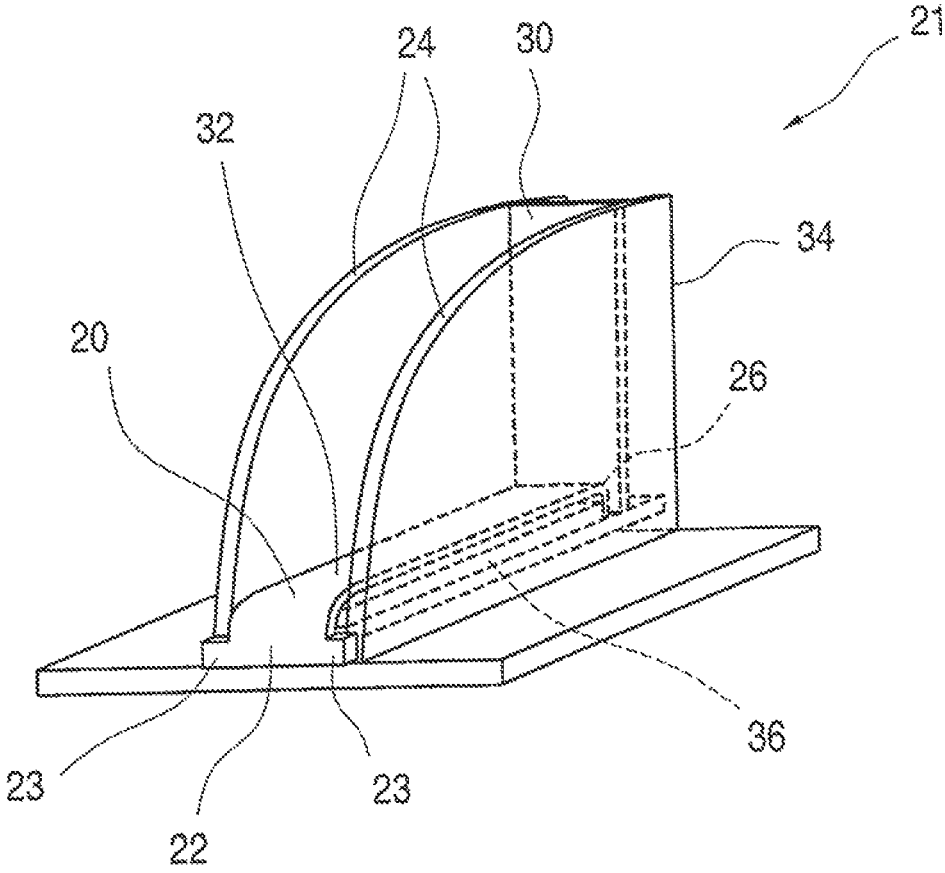
FIG. 2 is the embodiment of the invention in FIG. 1, with the latch in a horizontal position.

An actuating force, such as, for example, from seismic activity, can impart shock movement to the latch 20 that causes it to drop or tip from the upright position in FIG. 1, in the direction of arrow "A", to a horizontal position, such as shown in FIG. 2. As will be appreciated by those skilled in the art after reviewing this disclosure, in some embodiments, just a threshold amount of force is required to tip the latch 20 away from the rear wall 30, after which it can tip under the force of gravity to the horizontal position. The bend 26 in the bottom end portion of the latch 20 can catch on the retaining member 36 to help retain the bottom end portion in the track assembly 34 as the latch 20 drops from the upright position in FIG. 1 to the horizontal position in FIG. 2.

Figure 3:
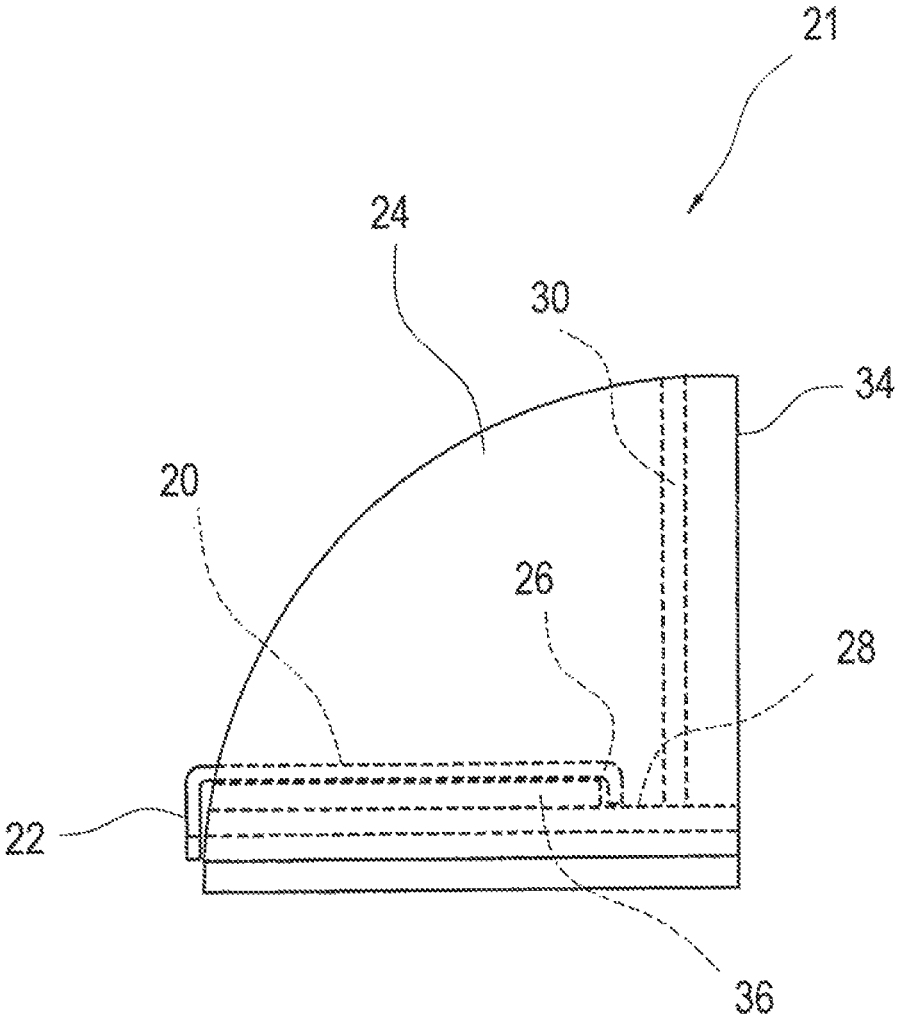
FIG. 3 is a side elevation view of the embodiment of the present invention shown in FIG. 2, again with the latch in a horizontal position.

Still referring to FIG. 2, in some embodiments, outside edge portions 23 of the contact surface 22 can be configured to slide along upper edges of the track walls 24, when the latch 20 drops, to help guide the contact surface 22. The upper edges of the track walls 24 can curve downward with a substantially constant radius curvature, as best seen in FIGS. 3 & 4.

Referring to FIGS. 2 & 6, once the latch 20 is actuated and falls to the horizontal position, the magnet 6 can be adjacent the contact surface 22 of the latch 20 when the cabinet door 101 closes. As those skilled in the art will appreciate after reviewing this disclosure, the magnet 6 and contact surface 22 can be selected and configured such that a magnetic force exerted therebetween can lock the cabinet door 101 to prevent it from being reopened by further actuating forces, while still allowing a user to pull the door 101 open. In some embodiments, a handle (not shown in the Figures) is provided on the cabinet 100.

Figure 7:
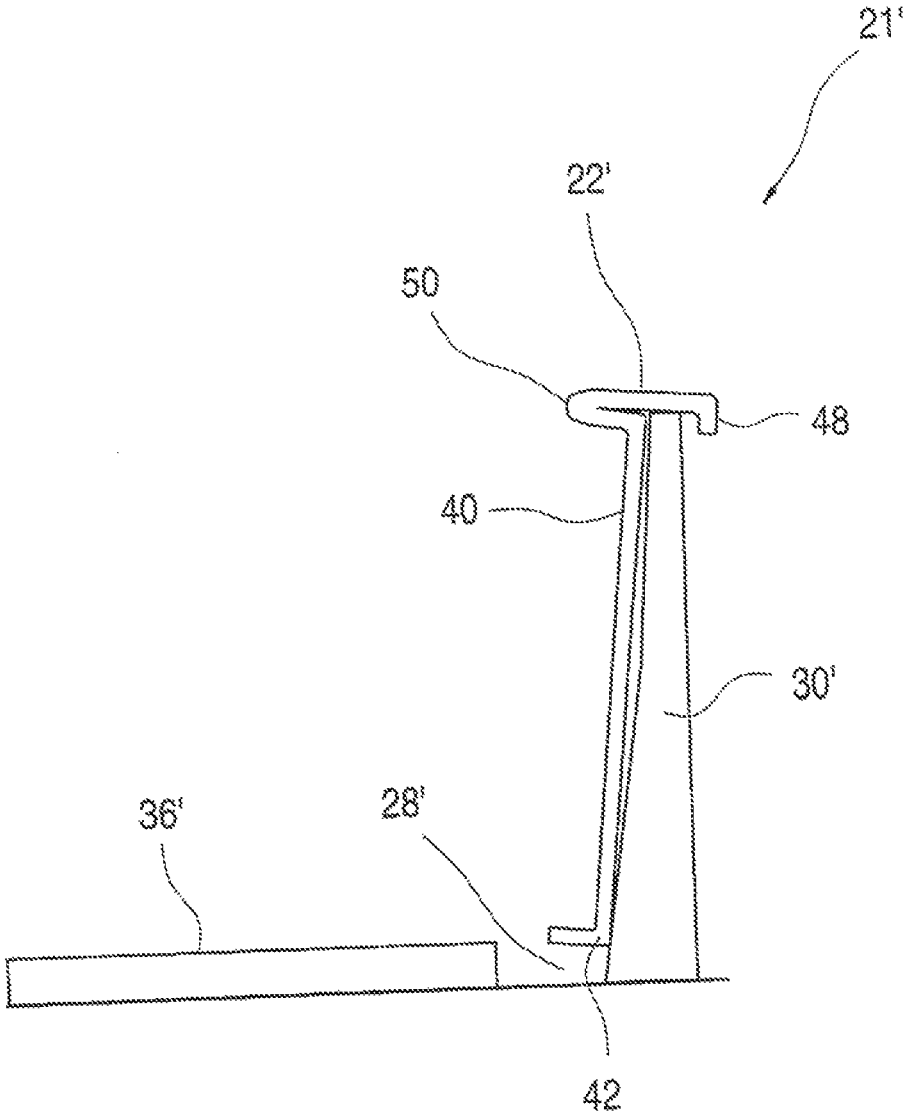
FIG. 7 is a side elevation view of an embodiment of the present invention, with a latch having an overlapped fold portion in an inactive mode.
Figure 8:
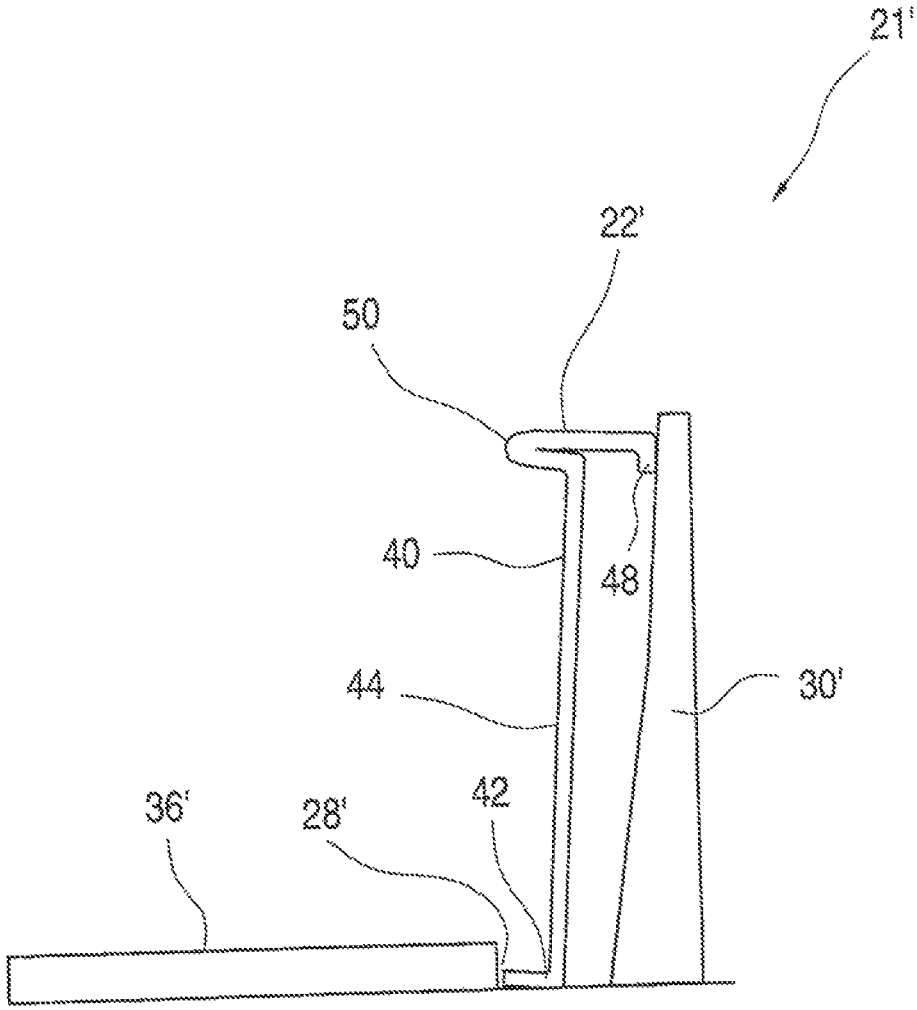
FIG. 8 is a side elevation view of the latch of FIG. 7, with the latch shown in an active mode.
Figure 9:
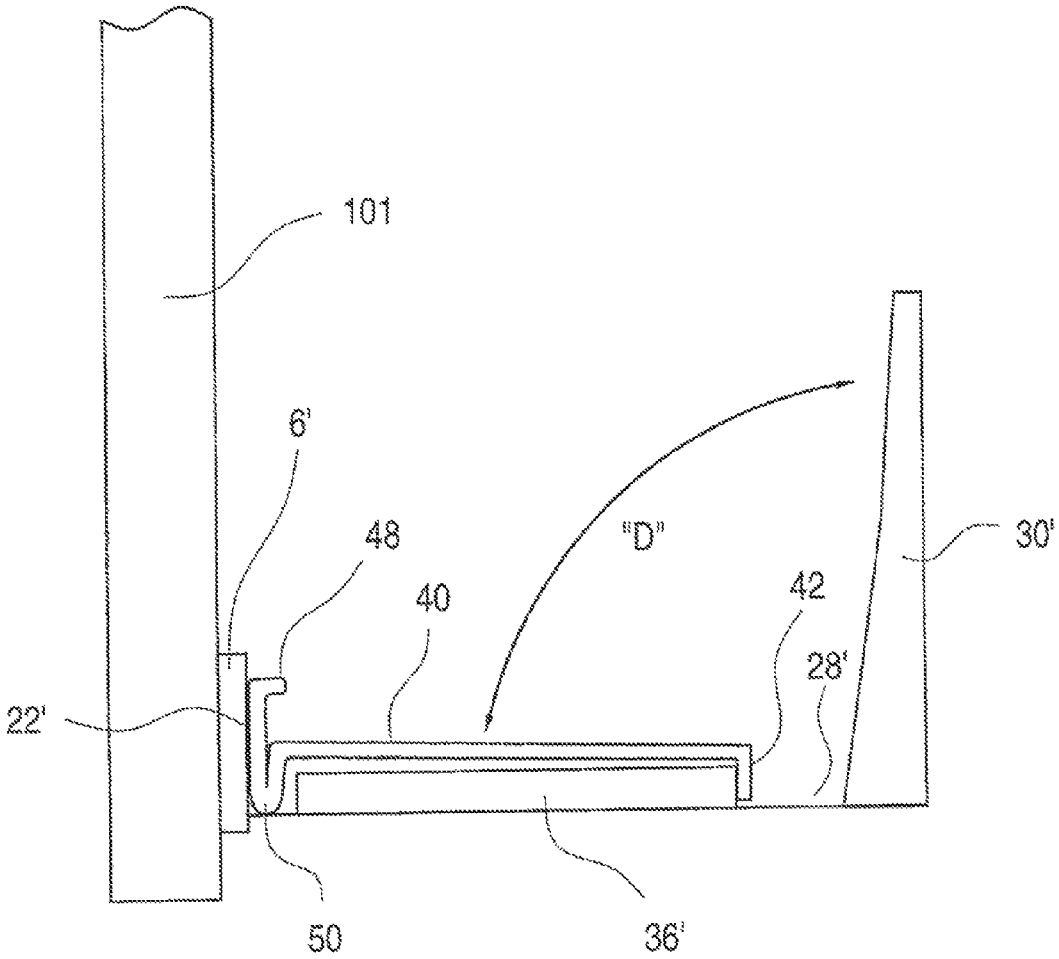
FIG. 9 is a side elevation view of the embodiment of the present invention shown in FIG. 8, with the latch having fallen from the upright position in FIG. 8 to a horizontal position on the retaining member of the track assembly, with a contact surface of the latch adjacent a magnet of a compartment door.

Referring now to FIGS. 7 & 8, in some embodiments of the present invention, the locking device 21' has a latch 40 with an overlapped fold 50 and an overhang member 48. The overlapped fold 50 can result in a larger surface area for the contact surface 22', as well as more ferrous mass near the contact surface 22'. The latch 40 can be hung on an upper edge portion of the rear wall 30' using the overhang member 48 of the latch 40, as best seen in FIG. 7. This places the shock-actuated lock, or locking device 21', in an inactive mode. Conversely, the locking device 21' can be set in an active mode by lifting the latch 40 off of the rear wall 30' and placing a bottom end portion thereof on a floor of the recess 28' with the overhang member 48 leaning against the rear wall 30', as best seen in FIG. 8. In this active mode, the latch 40 can be shock-actuated to tip by an actuating force. As can be seen in FIG. 9, an actuating force can cause the latch 40 to tip in the direction of arrow "D", coming to rest on the retainer 36' with the contact surface 22' facing outward, such that it can contact a magnet 6'. The magnet 6' can be attached to, or embedded within a cabinet door 101 or other moveable compartment wall, such as in previous embodiments of the present invention discussed above. Also, track walls, similar to previous embodiments disclosed herein, can be provided to guide the latch 40.

In some embodiments of the present invention, the latch 20, 40 or its contact surface 22, can itself comprise a permanent magnet, with a material attracted to the magnet is coupled to or embedded within the door 101. In this manner, the position of the magnetic can be reversed for various embodiments of the present invention.

Also, in some embodiments of the present invention as illustrated, the latch 20, 40 is a single piece displaceable member within the track assembly 34 and no other moving components are present in the track assembly 34.

U.S. Pat. No. 6,866,312 entitled "SHOCK-ACTUATED LOCK WITH RESETABLE BALL," including, without limitation, the drawings and detailed description thereof, is incorporated herein in its entirety. That patent discloses some embodiments of shock-actuated locking devices and locking methods that can be activated by seismic activity, including the elements of a ramp installed on a cabinet with a door, a ball made from ferrous material that is movably installed on the ramp, means for retaining the ball at an upper portion of the ramp (such as ribs formations on the ramp that provide a frictional surface), means for retaining the ball at a lower portion of the ramp for stopping the ball near an end portion of the lower portion of the ramp (such as a metal plate), and a magnet installed on the cabinet door that is attracted to the ball by an attractive force to lock the cabinet door when the ball is shock-actuated and displaced on the ramp to be alignable with the magnet on the cabinet door. These elements are disclosed in FIGS. 1, 2 & 4 of U.S. Pat. No. 6,866,312, as well as in other locations therein.

Although specific embodiments and examples of the present invention have been described supra for illustrative purposes, various equivalent modifications can be made without departing from the spirit and scope of the invention, as will be recognized by those skilled in the relevant art after reviewing the present disclosure. The various embodiments described can be combined to provide further embodiments. The described locking devices and assemblies, and methods of using the same can omit some elements or acts, can add other elements or acts, or can combine the elements or execute the acts in a different order or manner than that illustrated, to achieve various advantages of the invention. These and other changes can be made to the invention in light of the above detailed description.

In general, in the following claims, the terms used should not be construed to limit the invention to the specific embodiments disclosed in the specification. Accordingly, the invention is not limited by the disclosure, but instead its scope is determined entirely by the following claims.

What is claimed is:

1. A shock-actuated lock assembly comprising:

a latch having a contact surface;

a track assembly for the latch, at least a portion of the latch resting on the tack assembly and at least a portion of the track assembly being attached to an interior of a structure to which a door is attached, with the latch being retainable in the track assembly in a first position, said latch being capable of being displaced by tipping to a second position under an actuating force, the tipping of the latch being guided by the track assembly to align the contact surface after the latch is tipped;

a magnet configured to be coupled to the door and capable of exerting an attractive force on the contact surface to lock the door when the latch is in the second position; and wherein the latch further comprises an overhang member which can be manually mated against a wall of the track assembly to secure the latch to the wall for temporarily inactivating the shock-actuated lock assembly.

2. The shock-actuated lock assembly of claim 1 wherein the latch has an overlapped fold portion near the contact surface thereof.

3. The shock-actuated lock assembly of claim 1 wherein the track assembly has walls with upper edge portions that curve with a substantially constant radius of curvature.

* * * * *